US005757110A

United States Patent [19]

Motiduki et al.

[11] Patent Number: 5,757,110

[45] Date of Patent: May 26, 1998

[54] ELECTRICAL DISCHARGE LAMP WITH ULTRAVIOLET FILTERING GLOBE HAVING REAR END PART SUPPORTED INSULATING BASE

[75] Inventors: Kunimasa Motiduki; Masakazu Nagasawa; Yukio Wakimizu, all of Shizuoka, Japan

[73] Assignee: Koito Manufacturing Co., Ltd., Tokyo, Japan

[21] Appl. No.: 565,311

[22] Filed: Nov. 30, 1995

[30] Foreign Application Priority Data

Dec. 6, 1994 [JP] Japan ..... 6-301783

[51] Int. Cl.[6] ..... H01J 5/48

[52] U.S. Cl. ..... 313/25; 313/318.01; 313/318.09; 313/318.1

[58] Field of Search ..... 313/25, 318.01, 313/1, 318.02, 318.08, 318.1, 51, 634, 244, 256, 269; 362/255, 376, 378, 218; 439/602, 611

[56] References Cited

U.S. PATENT DOCUMENTS

| | | | |
|---|---|---|---|
| 3,855,495 | 12/1974 | Pappas et al. | 313/318.08 |
| 4,785,218 | 11/1988 | Kohl et al. | 313/318.08 |
| 5,253,153 | 10/1993 | Mathews et al. | 313/25 |
| 5,386,173 | 1/1995 | Kosmatka | 313/318.01 |
| 5,536,998 | 7/1996 | Sica | 313/25 |
| 5,627,428 | 5/1997 | Helbig et al. | 313/318.09 |

FOREIGN PATENT DOCUMENTS

| | | | |
|---|---|---|---|
| 0465083 | 1/1992 | European Pat. Off. . | |
| 0570068 | 11/1993 | European Pat. Off. . | |
| 3743627 | 7/1989 | Germany . | |
| 372858 | 3/1971 | U.S.S.R. | 313/25 |

OTHER PUBLICATIONS

Patent Abstracts of Japan, E-1387 of Jun. 24, 1993, vol. 17, No. 334.

*Primary Examiner*—Ashok Patel
*Assistant Examiner*—J. M. Patidar
*Attorney, Agent, or Firm*—Sughrue, Mion, Zinn, Macpeak & Seas, PLLC

[57] ABSTRACT

An electrical discharge lamp device in which an ultraviolet filtering globe tightly encloses a sealed glass bulb of an arc tube containing a pair of oppositely disposed electrodes to thereby form a unitary body. The rear end part of the arc tube extending from the ultraviolet filtering globe is supported by an insulating base, and the forward end part of the arc tube is supported by a lead support extending forward from the insulating base. An extending part is formed on the front face of a base main body made of synthetic resin, and the rear part of the ultraviolet filtering globe is supported by the tubular extending part. In this construction, stress is not concentrated on the portion of the arc tube supported by the base main body of the arc tube, and hence the durability of the arc tube is improved.

9 Claims, 3 Drawing Sheets

ELECTRICAL DISCHARGE LAMP WITH ULTRAVIOLET FILTERING GLOBE HAVING REAR END PART SUPPORTED INSULATING BASE

BACKGROUND OF THE INVENTION

The present invention relates to an electrical discharge lamp device in which the forward end of an arc tube is supported by a lead support extending from a base and the rear end thereof is directly supported by the base.

An example of a known electrical discharge lamp device of this general type is shown in FIG. 4. As depicted therein, a pair of long and short lead supports 3 and 4 are provided for supporting the front and the rear ends of an arc tube 5.

In the arc tube 5, a pair of electrodes 6 are oppositely disposed in the central part of a sealed glass bulb 5*a*. Pinch-sealed parts 5*b*, which seal molybdenum foils 7 therein, are also provided in the glass bulb. The molybdenum foils 7 are connected to respective ones of the electrodes 6. Lead wires 8 connected to the molybdenum foils 7 extend to the exterior through the sealing parts 5*b*. The lead wires 8 are welded to the lead supports 3 and 4. The lead support 3 is welded to the lead wire 8 located close thereto, while the lead support 4 is welded through a metal support 9 to the lead wire 8 located close to thereto.

A metal halide material (e.g., a sodiuum-thallium-indium series or a scandium-sodium series material) and mercury as a luminous material are contained in the sealed glass bulb 5*a*.

Reference numeral 1 designates a globe 1 for filtering out ultraviolet rays of wavelengths detrimental to health. The ultraviolet filtering globe 1 is fixed to a base 2 while enclosing the sealed glass bulb 5*a*.

The lead supports 3 and 4 also function as conductors for current fed to the electrodes 6, and hence a necessary mechanical strength and a good electrical conductivity are required. For this reason, these supports are generally made of a metallic material.

When the arc tube 5 is lit, the lead supports 3 and 4 are exposed to ultraviolet rays emitted from the discharge portion. Free electrons (negative charge) in the lead supports are excited to cause them to be ejected from the lead supports. These electrons, which collect on the surface of the sealed glass bulb 5*a*, attract metallic atoms (Na+) of positive charge from inside the sealed glass bulb 5*a*. Some of these metallic atoms pass through the shell of the sealed glass bulb 5*a*. As a result, the concentration of the luminous materials in the sealed glass bulb 5*a* is reduced, and therefore the lifetime of the arc tube 5 is reduced.

To solve this problem, an electrical discharge lamp device as shown in FIG. 5 has been proposed (but not yet publicly known). In this device, the ultraviolet filtering globe 1 is welded to the arc tube 5 in a state such that the sealed glass bulb 5*a* is placed in a space between the ultraviolet cutting globe 1 and the arc tube 5 in a sealing fashion. The rear end of the arc tube 5 is directly supported by the forward end of the insulating base 2.

The base 2 includes a base main body 2*a* made of synthetic resin and a disc 2*b* made of ceramic material. The base main body 2*a*, located at the rear end of the base 2, is to be coupled to a power supply. The disc 2*b* is fixed to the forward end of the base main body 2*a* by means of screws. The rear end of the arc tube 5 is inserted into an insertion hole 2*c* formed in the disc 2*b*, and is firmly held by an inorganic adhesive layer 2*d* so as to fit into the front part of the disc 2*b*.

The ultraviolet filtering globe 1 cuts ultraviolet rays in wavelengths detrimental to health that are contained in the radiation emitted from the arc tube 5. Therefore, the proposed discharge lamp device succeeds in solving the problem of the lead support 3 being exposed to ultraviolet rays and free electrons therein being excited to be ejected, etc., such that the concentration of the gas sealed in the sealed glass bulb 5*a* is eventually reduced.

In FIG. 5, like reference numerals are used for designating like or equivalent portions in FIG. 4.

However, in the electrical discharge lamp device shown in FIG. 5, the rear end of the arc tube is held by the insertion hole 2*c* of the forward end of the base 2. Because of this structure, there is a possibility that the arc tube 5 will be damaged or broken at the rear end thereof close to the base 2, as indicated by "A" in FIG. 5. Moreover, as the speed of the vehicle increases, the amount of vibration caused by the engine, etc., and transmitted to the discharge lamp device contained in the headlamp is increased. At the forward end of the arc tube 5 little problem arises since the forward end thereof is relatively resiliently supported by the lead support 3 and the lead wire 8. On the other hand, the rear end of the arc tube 5 is inserted into the insertion hole 2*c* and rigidly bonded thereto by the adhesive layer 2*d*. Shock stress and repetitive stress concentrically act on the neck of the arc tube 5, thereby possibly breaking the neck of the tube.

SUMMARY OF THE INVENTION

The present invention has been made in view of the above circumstances. Accordingly, an object of the invention is to provide an electrical discharge lamp device which succeeds in solving the problem of breakage of the rear end part of the arc tube.

To achieve the above object, in an electrical discharge lamp device an ultraviolet filtering globe tightly enclosing a sealed glass bulb containing a pair of oppositely disposed electrodes is fitted to an arc tube having a sealed glass bulb to thereby form a unitary body, the rear end part of the arc tube that extends from the ultraviolet filtering globe is supported by an insulating base, and the forward end part of the arc tube is supported by a lead support extending forward from the insulating base, wherein the forward end part of the insulating base extends forward, and the rear end part of the ultraviolet filtering globe is supported by the forward-extending end part of the insulating base.

The insulating base may include a base main body, made of synthetic resin, of which the rear part has a connector for the discharge lamp to make connection to a power supply. A ceramic disc, which is firmly fixed to the front face of the base main body, has formed therein an arc tube insertion hole into which the rear end part of the arc tube is inserted. The rear end part of the ultraviolet filtering globe is supported by a tubular extending part located so as to surround the arc tube insertion hole on the front face of the disc.

Ultraviolet rays detrimental to health and contained in light emitted from the arc tube are filtered out by the ultraviolet filtering globe which surrounds the sealed glass bulb. Thus, the situation where the lead support is excited by ultraviolet rays to emit free electrons, which eventually reduce the concentration of the gas sealed in the lead support, can never occur.

In the rear portion of the arc tube/globe structure, the rear end part of the ultraviolet filtering globe, which is larger in diameter than the arc tube, is supported by the extending part at the forward end of the base. Accordingly, there is no concentration of stress on the extending part of the read end of the arc tube. The rear end part of the arc tube/globe structure is thus protected from damage, unlike the conventional device.

Moreover, light emitted from the pinch-sealed part of the rear end of the arc tube, which possibly can cause glare, is intercepted by the extending part of the forward end of the base, which surrounds the rear pinch-sealed part of the arc tube.

Further, the ceramic disc intercepts ultraviolet rays directed toward the base main body, and further cuts the heat caused by the light emitted by the arc tube and which is transmitted to the base main body. Also, with the extending part of the disc supporting the rear end pat of the ultraviolet filtering globe, the arc tube breakage problem is solved.

DESCRIPTION OF THE PREFERRED EMBODIMENTS

Figure 1:
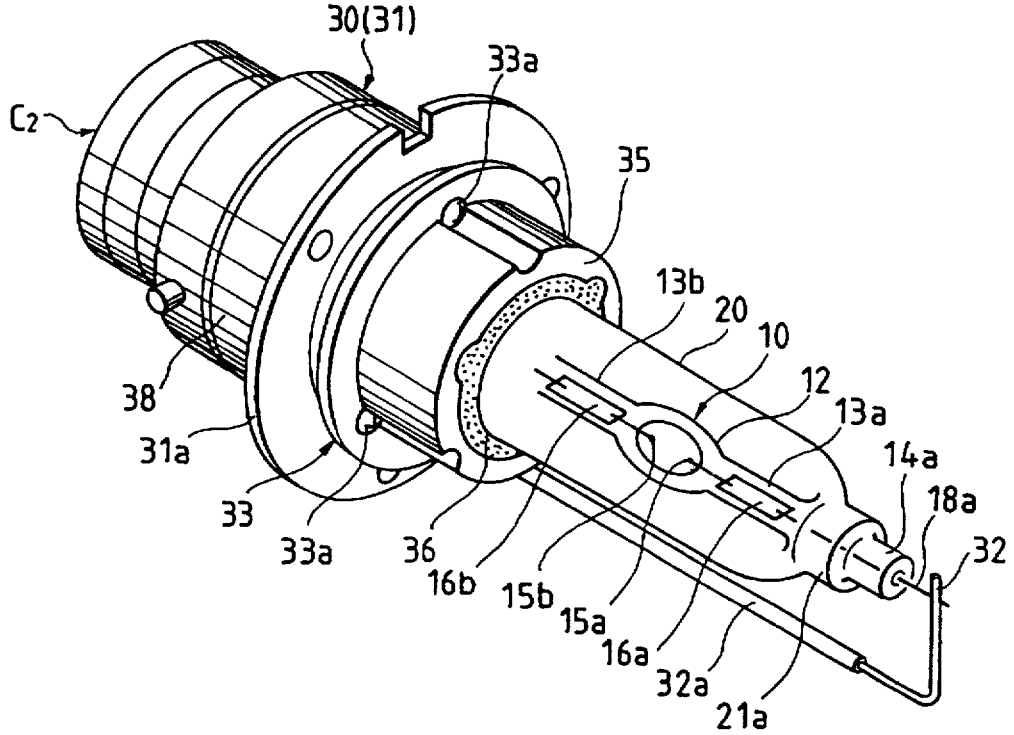
FIG. 1 is a perspective view showing a discharge lamp device according to an embodiment of the present invention.
Figure 2:
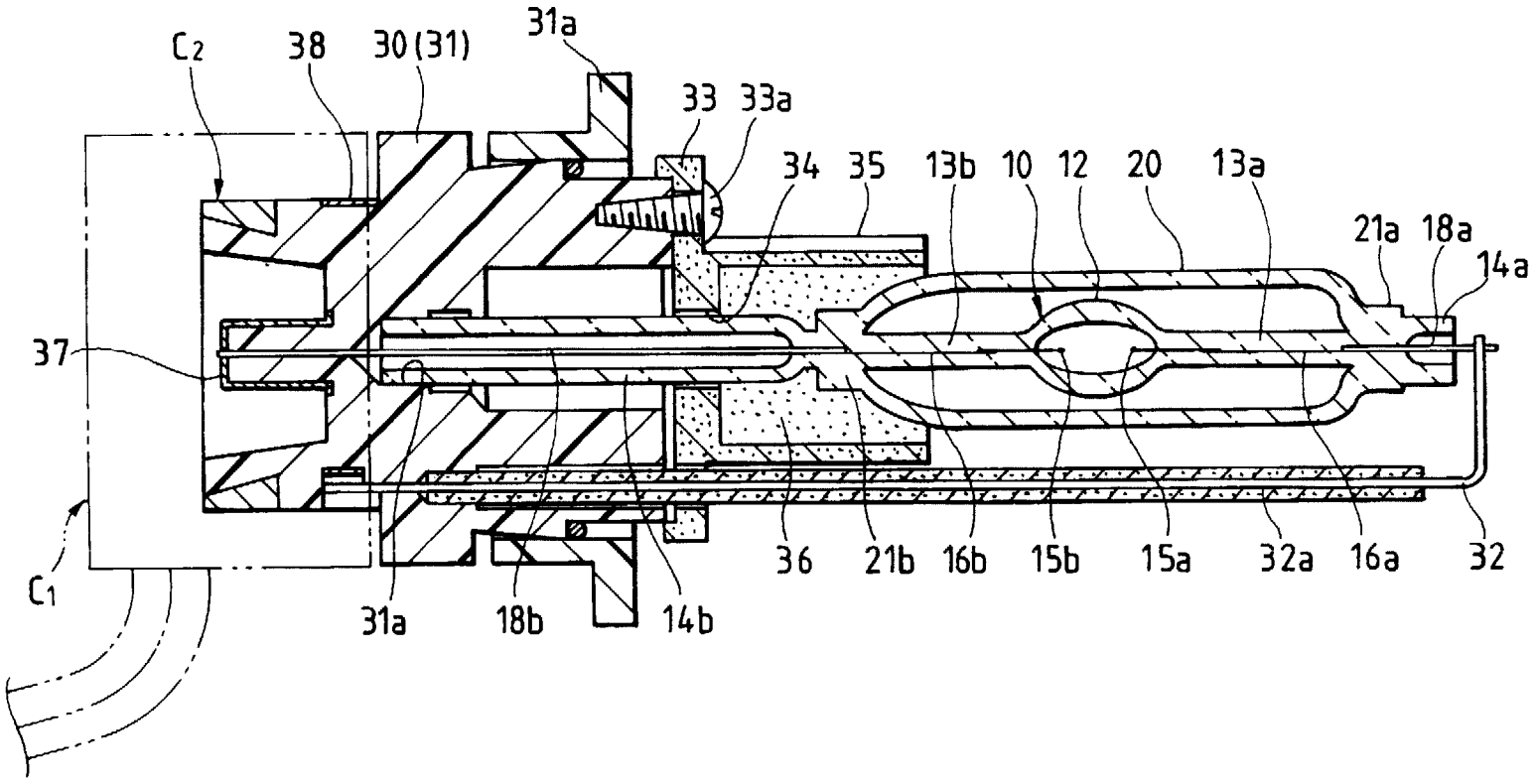
FIG. 2 is a longitudinal view showing the discharge lamp device of FIG. 1.
Figure 5:
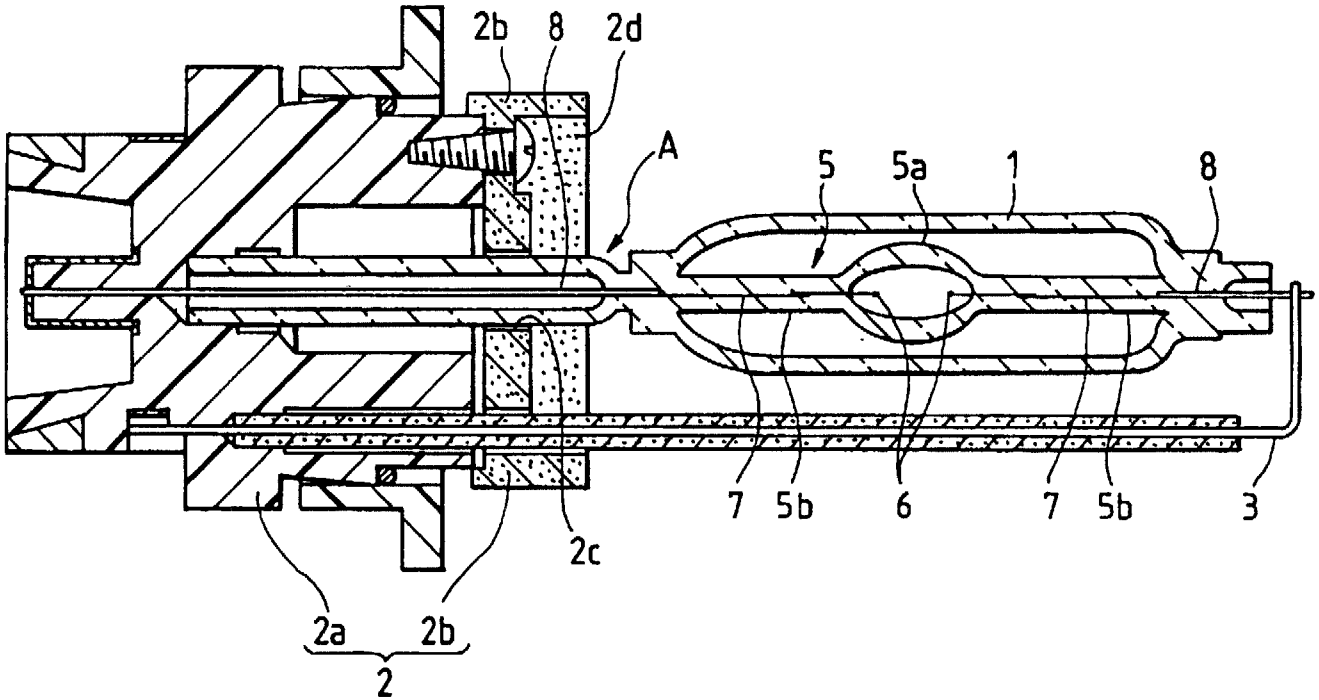
FIG. 5 is a longitudinal sectional view showing a conventional electrical discharge lamp device.

FIGS. 1 and 2 cooperatively show a first embodiment of an electrical discharge lamp device constructed according to the present invention, of which FIG. 1 is a perspective view showing the discharge lamp device, and FIG. 2 is a longitudinal view showing the discharge lamp device.

In these figures, the discharge lamp device is formed of an arc tube 10, a globe 20 for cutting ultraviolet rays, and a lead support 32. The arc tube 10 contains a sealed glass bulb 12 in which a pair of electrodes 15*a* and 15*b* are disposed. The ultraviolet filtering globe 20, cylindrical in shape, hermetically encloses the sealed glass bulb 12. The lead support 32, which extends from the forward end of an insulating base 30, supports the forward end of the arc-tube/globe structure of which the rear end is fixedly supported by the insulating base 30.

The arc tube 10 is generally in the form of a silica glass pipe. In the structure of the arc tube 10, the sealed glass bulb 12, elliptical in cross section, is located at a preset position between pinch-sealed parts 13*a* and 13*b*, which are rectangular in cross section when viewed longitudinally.

Starting rare gas, mercury, and a metal halide material (e.g., a luminous material of the sodium-thallium-indium series) is sealed in the sealed glass bulb 12.

Rectangular molybdenum foils 16*a* and 16*b* are sealed in the pinch-sealed parts 13*a* and 13*b*, respectively. Within the sealed glass bulb 12, the molybdenum foil 16*a* is connected at one end to the tungsten electrode 15*a*, and at the other end to a lead wire 18*a* extending to the outside. Similarly, the molybdenum foil 16*b* is connected at one end to the tungsten electrode 15*b*, and at the other end to a lead wire 18*b* extending to outside.

The cylindrical ultraviolet filtering globe 20 is welded to the pinch-sealed parts 13*a* and 13*b*.

An extending part 14*a*, which is a non-pinch-sealed part, is continuous to the pinch-sealed part 13*a* of the arc tube 10. Similarly, an extending part 14*b*, which is also a non-pinch-sealed part, is continuous with the pinch-sealed part 13*b*.

The diameter and the length of the ultraviolet filtering globe 20 are selected so as to cover the regions of the arc tube 10 from the sealed glass bulb 12 to the pinch-sealed parts 13*a* and 13*b*. The ultraviolet filtering globe 20 is welded to the pinch-sealed parts 13*a* and 13*b* of the arc tube 10, thereby to seal the pinch-sealed parts 13*a* and 13*b* so that the ultraviolet filtering globe 20 and the arc tube 10 are coupled into a unitary form. Thus, the sealed glass bulb 12 of the arc tube 10 is sealed in the ultraviolet filtering globe 20.

Reference numerals 21*a* and 21*b* indicate the welding parts (sealing parts) of the ultraviolet filtering globe 20 and the arc tube 10.

The ultraviolet filtering globe 20 is made of silica glass doped with selenium, for example, which has the ability to cut ultraviolet rays. The ultraviolet filtering globe 20 is coated with a material (ZnO) for cutting ultraviolet rays in order to surely filter out ultraviolet rays in a specific range of wavelengths detrimental to health, those ultraviolet rays being contained in the light rays emitted from the sealed glass bulb 12.

The ultraviolet filtering globe 20 is evacuated or filled with an inert gas so as to reduce the amount of thermal radiation from the sealed glass bulb 12. The ultraviolet filtering function of the ultraviolet filtering film, which is formed over the outer surface of the ultraviolet filtering globe 20, is reduced if the film is subjected to a high temperature (e.g., above approximately 700° C.), with the amount of reduction depending on the type of ultraviolet filtering film used. It is for these reasons that the ultraviolet filtering globe 20 is welded to the arc tube 10 at the pinch-sealed parts 13*a* and 13*b* located apart from the sealed glass bulb 12 heated to a high temperature.

To prevent the ultraviolet filtering film from being heated in excess of the heat resistant temperature of the film, the amount of heat transmitted to the film may be adjusted by increasing the size of the ultraviolet filtering globe 20.

The light rays, after being transmitted through the ultraviolet filtering film, i.e., after the ultraviolet ray component of the light rays emitted from the sealed glass bulb 12 has been filtered out, strike the lead support 32. Accordingly, the excitation of free electrons in the lead support 32 is reduced so that a reduced number of free electrons are emitted from the lead support 32.

Even if the lead support 32 is excited by ultraviolet rays so as to emit free electrons, those electrons tend to collect on the surface of the ultraviolet filtering globe 20, which is sufficiently spaced apart from the sealed glass bulb 12. No further approach of the free electrons to the sealed glass bulb 12 is possible.

The attraction force (energy) of the free electrons acting on the sodium atoms of the luminous materials in the sealed glass bulb 12 is too weak to pull the sodium atoms through the wall of the sealed glass bulb 12. Therefore, the concentration of the sodium atoms of the luminous material inside the sealed glass bulb 12 is hardly reduced.

The insulating base 30 includes a base main body 31 made of synthetic resin and a disc 33 made of ceramic material. The base main body 31 forms a connector $C_2$ closer to the lamp. A connector $C_1$, which is to be connected to a power source, is removably attached to the connector $C_2$.

The disc 33 is fixed to the forward end of the base main body 31. The disc 33 is provided for protecting the base main body 31 from ultraviolet rays and high temperature.

The connector $C_2$ includes a cap-like terminal 37 and a belt-like terminal 38. The cap-like terminal 37 is electrically continuous to the lead wire 18b of the rear portion of the arc tube 10. The belt-like terminal 38 is electrically continuous with the lead support 32. When the connector $C_1$ is applied to the connector $C_2$, the terminals 37 and 38 are brought into contact with a pair of terminals (not shown) of the connector $C_1$, thereby setting up a conductive state therebetween.

In the figures, reference numeral 31a designates a focusing ring fixed to the base main body 31; 32a, an insulating tube, made of ceramic material, fitted to the lead support 32; and 33a, screws for fixing the ceramic disc 33 to the base main body 31.

In the forward end portion of the arc tube/globe structure in which the ultraviolet filtering globe 20 is welded to the arc tube 10 into a unitary body, the forward end part of the arc tube 10 extending from the ultraviolet filtering globe 20 is insert-molded into the synthetic resin base main body 31, or inserted thereinto after molding, and is supported by the metallic lead support 32 protruding toward the front of the disc 33.

In the rear end portion of the arc tube/globe structure, the rear end part of the arc tube 10 extending from the ultraviolet filtering globe 20 is inserted into an arc tube insertion hole 34 of the disc 33, which is fixed to the front face of the base main body 31 by means of screws, and further into and supported by the engaging ring 31a of the base main body 31.

The rear end part of the ultraviolet filtering globe 20 is fixedly held by an inorganic adhesive layer 36, which is inserted into a tubular extending part 35. The tubular extending part 35 is located surrounding the arc tube insertion hole 34 of the front face of the disc 33.

The forward end part of the arc tube/globe structure is resiliently supported by the lead wire 18a and the lead support 32. Because of this, the front part of the arc tube 10 is isolated from vibration of the engine, vibration caused with the running of the automobile, etc., and hence is free from unpredictable stresses caused by such a load.

In the rear end portion of the arc tube/globe structure, the rear end part of the ultraviolet filtering globe 20, which is larger in the cross section than the arc tube 10, is held by the inorganic adhesive layer 36 solidified in the tubular extending part 35. Therefore, the load (including vibration of the engine and vibration caused by the running of the automobile) which acts on the rear end portion of the arc tube/globe structure is dispersed through the ultraviolet filtering globe 20. For this reason, there is no chance that stress will be concentrated at specific locations on the ultraviolet filtering globe 20 supported by the tubular extending part 35 and the arc tube 10 inserted into and supported by the arc tube insertion hole 34. Accordingly, the arc tube 10 and the ultraviolet filtering globe 20 are protected from damage and breakage.

Part of the light emitted from the sealed glass bulb 12 of the arc tube 10 is sometimes introduced into the pinch-sealed parts 13a and 13b, and is emitted from those parts. The light emitted from the pinch-sealed parts 13a and 13b is reflected by the effective reflecting surface of a reflector (not shown), and gives rise to glare (which is caused by light originating from a part of the headlamp closer to the oncoming car). Such light is uncontrollable in light distribution.

The light emitted from the pinch-sealed part 13b is intercepted by the tubular extending part 35 (more exactly the inorganic adhesive layer 36 therein), and gives rise to little glare.

Figure 3:
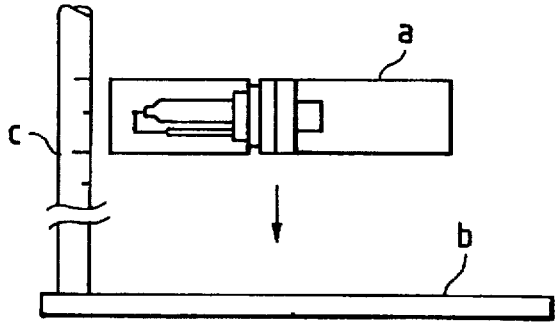
FIG. 3 is a diagram showing the result of a drop test.
Figure 4:
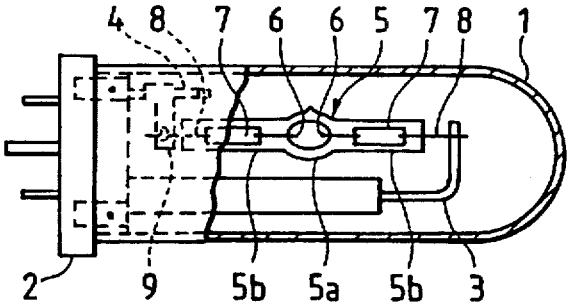
FIG. 4 PRIOR ART
FIG. 4 is a longitudinal sectional view showing a known electrical discharge lamp device.

The diagram of FIG. 3 shows the results of a drop test of the discharge lamp device (FIGS. 1 and 2) thus constructed.

In the test, electrical discharge lamp devices of the invention and conventional electrical discharge lamp devices were used. Cases a made of transparent synthetic resin were used for containing those lamp devices. A cedar board b 15 mm thick was placed on the floor. The lamp device contained in the case a was dropped onto the cedar board b from various heights. Damage such as cracking, breaking or the like of the arc tube 10 of the discharge lamp device was checked.

When the conventional discharge lamp device was dropped from a height of 80 cm or higher, the arc tube 10 was damaged. In the case of the discharge lamp devices of the invention though, no damage was found when dropped from a height of 160 cm.

In FIG. 3, reference character c indicates a scale.

Further, the electrical discharge lamp devices were subjected to a resonance measurement using a vibration tester and a vibration endurance test. The results proved that the electrical discharge lamp devices of the invention could be used for automobile bulbs.

In the above-mentioned embodiment, the rear end part, which is substantially straight in shape, of the ultraviolet filtering globe 20 is supported by the tubular extending part 35. The portion to be supported by the tubular extending part 35 is not limited though to the straight rear end part of the ultraviolet filtering globe 20, but may be any portion if it is the rear part of the globe including the rear welding part 21b.

In the above-described embodiment, the ultraviolet filtering film 22 coated over the ultraviolet filtering globe 20 cuts ultraviolet rays. Hard glass (not silica glass) may be used for the ultraviolet filtering globe 20. Where the ultraviolet filtering globe 20 is made of silica glass, the ultraviolet filtering film may be omitted.

As can be seen from the foregoing description, in the electrical discharge lamp device of the present invention, ultraviolet rays detrimental to health are filtered out by the ultraviolet filtering globe. Thus, the situation will never occur where the lead support is excited by ultraviolet rays to emit free electrons and the free electrons reduce the concentration of the gas sealed in the lead support.

In the rear portion of the arc tube/globe structure, the rear end part of the ultraviolet filtering globe, which is larger in diameter than the arc tube, is supported by the extending part of the forward end of the base. Accordingly, stress is not concentrated on the extending part on the rear end of the arc tube. Also, the rear end part of the arc tube/globe structure is not damaged, although the possibility of damage in that area is unavoidable in the conventional device.

The electrical discharge lamp device endures a long period use. The light that is emitted from the pinch-sealed part 13b of the rear end of the arc tube, and which can possibly give rise to glare, is intercepted by the extending part on the forward end of the base which supports the rear end part of the ultraviolet filtering globe. Therefore, little or no glare is produced.

What is claimed is:

1. An electrical discharge lamp device comprising: an arc tube comprising a sealed glass bulb containing a pair of oppositely disposed electrodes; an ultraviolet filtering globe tightly enclosing said arc tube and forming a unitary body with said arc tube; an insulating base, said insulating base having a forward extending part; a rear end part of said ultraviolet filtering globe and a rear end part of said arc tube extending from said ultraviolet filtering globe being supported by said forward extending part of said insulating base; and a lead support extending forward from said insulating base, a forward end part of said arc tube being supported by said lead support.

2. The electrical discharge lamp device according to claim 1, wherein said insulating base comprises a base main body made of a synthetic resin, a connector for the discharge lamp formed at a rear portion of said base main body, and a ceramic disc, fixed to a front face of said base main body, having an arc tube insertion hole into which said rear end part of said arc tube is inserted.

3. The electrical discharge lamp device according to claim 2, wherein said forward extending part of said insulating base comprises a tubular extending part surrounding said arc tube insertion hole on the front face of the disc, said rear end part of said ultraviolet filtering globe being supported within said tubular extending part.

4. The electrical discharge lamp device according to claim 3, further comprising an inorganic adhesive material fixing said rear end part of said ultraviolet filtering globe to said tubular extending part.

5. The electrical discharge lamp device according to claim 2, further comprising at least one screw for securing said disc to said base main body.

6. The electrical discharge lamp device according to claim 2, further comprising an engaging ring fixed to said base main body, said rear end part of said arc tube being inserted into and supported by said engaging ring.

7. The electrical discharge lamp device according to claim 1, wherein said ultraviolet filtering globe is made of silica glass doped with selenium.

8. The electrical discharge lamp device according to claim 7, wherein the outer surface of said ultraviolet filtering globe is coated with a film of ZnO.

9. The electrical discharge lamp device according to claim 7, wherein said ultraviolet filtering globe is filled with an inert gas.

* * * * *